US005333444A

United States Patent [19]

Meng

[11] Patent Number: 5,333,444

[45] Date of Patent: Aug. 2, 1994

[54] SUPERCONDUCTING ELECTROMAGNETIC THRUSTER

[75] Inventor: James C. S. Meng, Portsmouth, R.I.

[73] Assignee: The United States of America as represented by the Secretary of the Navy, Washington, D.C.

[21] Appl. No.: 16,324

[22] Filed: Feb. 11, 1993

[51] Int. Cl.[5] ..... B63H 11/00

[52] U.S. Cl. ..... 60/221; 440/6; 62/51.3

[58] Field of Search ..... 60/221, 202, 203.1; 440/6, 38; 62/51.3; 505/892

[56] References Cited

U.S. PATENT DOCUMENTS

| | | | |
|---|---|---|---|
| 2,997,013 | 8/1961 | Rice | 60/202 |
| 4,767,364 | 8/1988 | Lenz | 60/221 |
| 4,782,671 | 11/1988 | Breneman et al. | 62/51.3 |
| 4,790,147 | 12/1988 | Kuriyama et al. | 62/51.3 |
| 5,087,215 | 2/1992 | Simuni | 60/202 |
| 5,117,141 | 5/1992 | Hawsey et al. | 440/6 |
| 5,211,006 | 5/1993 | Sohnly | 60/202 |
| 5,249,990 | 10/1993 | Laukien | 60/202 |

FOREIGN PATENT DOCUMENTS

| | | | |
|---|---|---|---|
| 3916882 | 11/1990 | Fed. Rep. of Germany | 440/6 |
| 403248995A | 11/1991 | Japan | 440/6 |

OTHER PUBLICATIONS

"Superconductivity Goes to Sea", Dennis Normile, Popular Science, Nov. 1992, pp. 80–85.

"Yoshiro Saji and His Magnetic Ship", John Langone, Discover, Apr. 1985, pp. 42–44, 48.

*Primary Examiner*—Richard A. Bertsch
*Assistant Examiner*—Howard R. Richman
*Attorney, Agent, or Firm*—Michael J. McGowan; Prithvi C. Lall; Michael F. Oglo

[57] ABSTRACT

An electromagnetic thruster for marine vehicles using a jet of water driven by the interaction of a mutually perpendicular intensified magnetic field and an intensified electric field is disclosed. The intensified magnetic field is produced by superconducting coils cooled by a coolant such as liquid helium. An intensified electric field is produced by passing high amperage current across the seawater jet. These interacting fields produce a Lorentz force perpendicular to mutually perpendicular electric and magnetic field vectors which is used to drive the seawater jet. In some embodiments, the force may also be used to draw water into the jet from the boundary layer flow around the vehicle thereby reducing boundary layer turbulence and associated radiated noise.

3 Claims, 11 Drawing Sheets

SUPERCONDUCTING ELECTROMAGNETIC THRUSTER

STATEMENT OF GOVERNMENT INTEREST

The invention described herein may be manufactured and used by or for the Government of the United States of America for Governmental purposes without the payment of any royalties thereon or therefor.

CROSS REFERENCES TO RELATED PATENT APPLICATIONS

The instant application is related to my four co-pending Patent Applications entitled SUPERCONDUCTING ELECTROMAGNETIC TORPEDO LAUNCHER (U.S. patent application Ser. No. 08/016,349); MAGNETOSTRICTIVE BOUNDARY LAYER CONTROL SYSTEM (U.S. patent application Ser. No. 08/016,325); SEAWATER MAGNETOHYDRODYNAMIC TEST APPARATUS (U.S. patent application Ser. No. 08/016,328); and ACTIVE TURBULENCE CONTROL USING MICROELECTRODES, PERMANENT MAGNETS IN MICROGROOVES (U.S. patent application Ser. No. 08/016,326) having same filing date.

BACKGROUND OF THE INVENTION (1) Field of the Invention

The present invention relates to propulsion systems for marine vehicles and more particularly to electromagnetic thruster systems.

(2) Description of the Prior Art

It is well known that when an electric current is passed through a wire or any other conductor placed in a magnetic field, an electromagnetic force, referred to as a Lorentz force, pushes the wire in a direction perpendicular to the wire and the magnetic field. Applying this law of physics to electromagnetic propulsion systems, the conductor of electricity is seawater instead of a wire. An electric current is passed through the seawater by the use of high current density seawater electrodes. The electrodes are positioned such that the electric current flows at right angles to the magnetic field generated by the electromagnets. Hence, a Lorentz force is produced which acts against the conductive seawater which, in turn, is pushed backward, propelling the ship, submarine or torpedo forward. This principle of electromagnetic propulsion was described in detail in U.S. Pat. No. 2,997,013, issued to Warren A. Rice on Aug. 22, 1961.

However, practical applications of prior electromagnetic propulsion systems have been limited by water's low electric conductivity and by the relatively low maximum available magnetic flux density of approximately 0.6 Telsa (T). In 1979, Hummert conducted an evaluation of a DC electromagnetic thruster (EMT) in seawater. Hummert's results revealed the possibility of EMT increased efficiency if the magnetic flux density could be increased to 5T. In 1983, studies conducted by Japanese scientists, Tada and Saji, concluded that only a breakthrough in superconductivity would bring about advances in electromagnetic propulsion.

Recent advances have been made in two areas, both of which improve the practicality of electromagnetic thrusters. First, superconducting materials are available with critical temperatures increased from four degrees Kelvin (4° K.) to ninety-eight degrees Kelvin (98° K.); second, the critical magnetic field strength has been raised from 12T to 70T. These developments are indicators of promising increases in the efficiency of an electromagnetic thruster.

SUMMARY OF THE INVENTION

It is an object of this invention to provide an electromagnetic drive for marine vehicles.

It is another object of this invention to provide a drive for marine vehicles having no moving parts.

It is yet another object to provide a boundary layer flow control mechanism using the intake section of an electromagnetic drive.

Yet another object is to provide a marine drive having a reduced noise signature.

Accordingly, the invention is a magnetohydrodynamic propulsion system for marine vehicles which uses a seawater jet driven by the interaction of a magnetic field and an electric field. Superconducting electromagnets, using liquid helium as a coolant, produce an intensified magnetic field which is setup perpendicular to an intensified electric field produced by passing current through the seawater. The interaction of the two fields (electric field and magnetic field) produces a thrust force which pushes the vehicle forward or rearward without the use of a conventional propeller or any other rotating parts. The intake water, used as a working fluid for the thruster, is drawn from the surface of the hull thereby reducing boundary layer turbulence and thus radiated noise.

BRIEF DESCRIPTION OF THE DRAWINGS

The foregoing objects and numerous other advantages of this invention will be more fully understood from the following detailed description when read with reference to the appended drawings, wherein.

DESCRIPTION OF THE PREFERRED EMBODIMENTS

Figure 1:
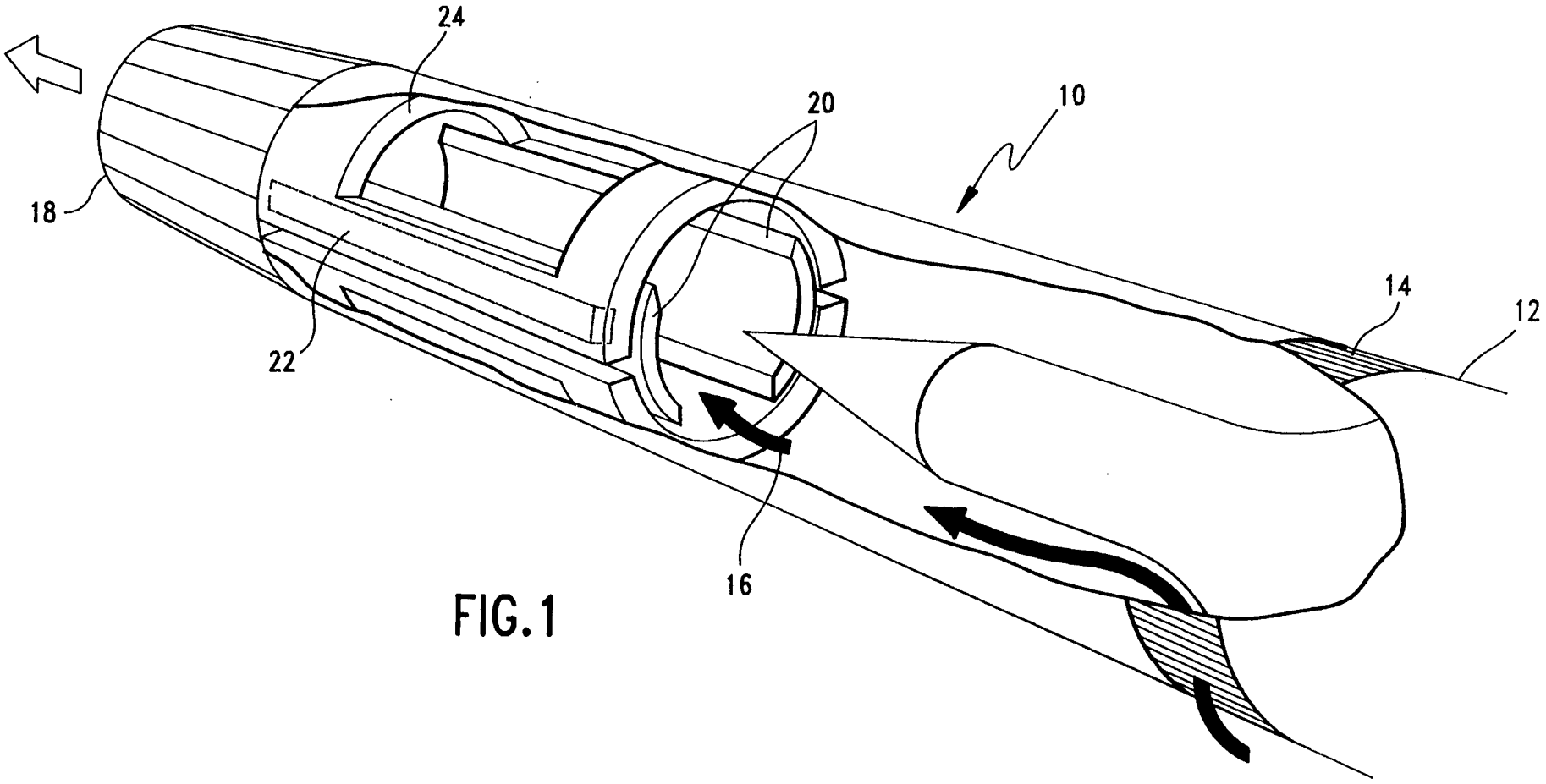
FIG. 1 is a cut-away view of the electromagnetic thruster.

Referring now to FIG. 1, the electromagnetic thruster, denoted generally by the reference numeral 10, is shown with the major elements identified. For illustration, the thruster is shown as installed on a small marine vehicle such as a torpedo. A water intake section 14 is located on hull 12 of a marine vehicle using a porous skin to admit seawater. Seawater duct or ducting 16 directs the water from the intake, through the main body of the thruster 10, and out the exit nozzle 18. Electrodes 20 are positioned along the inner surface of the seawater duct so as to produce an electric current through the seawater working fluid. Super-conducting electromagnet 22 is positioned around the outside of seawater duct 16. Superconductivity is provided by enclosing the coils of the electromagnet in a cryogenic dewar 24.

Figure 2:
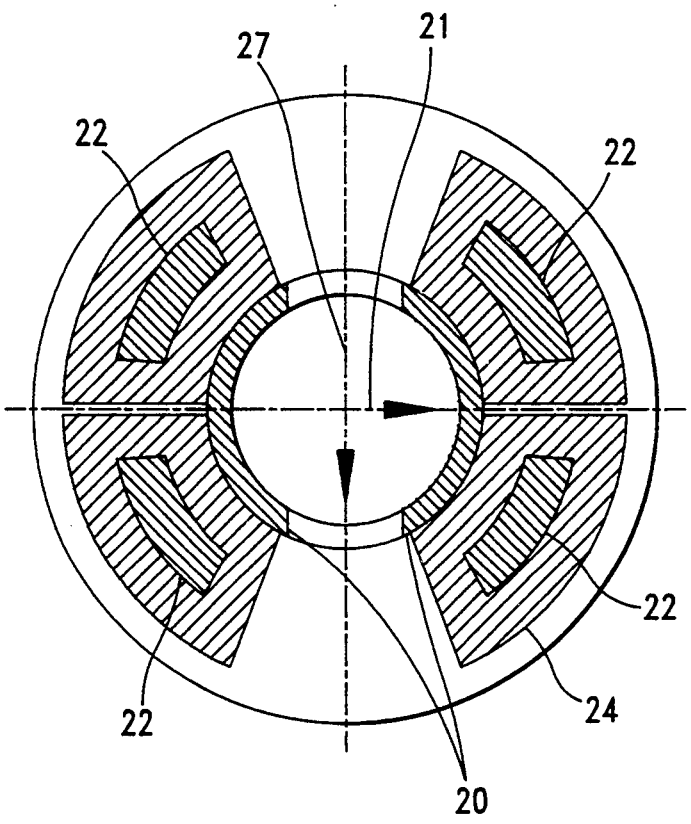
FIG. 2 is a cross-sectional view of the electromagnetic thruster.

FIG. 2 is cross-section of the thruster 10 shown in FIG. 1 with the seawater duct 16 having electrodes 20 along the sides thereof. Electrodes 20 pass high amperage current through the seawater working fluid setting up an electric field represented by electric field vector arrow 21. A cryogenic dewar 24 encloses electromagnets 22 to provide superconductivity. The superconducting magnets produce an intensified magnetic field represented by magnetic vector arrow 27.

Figure 3:
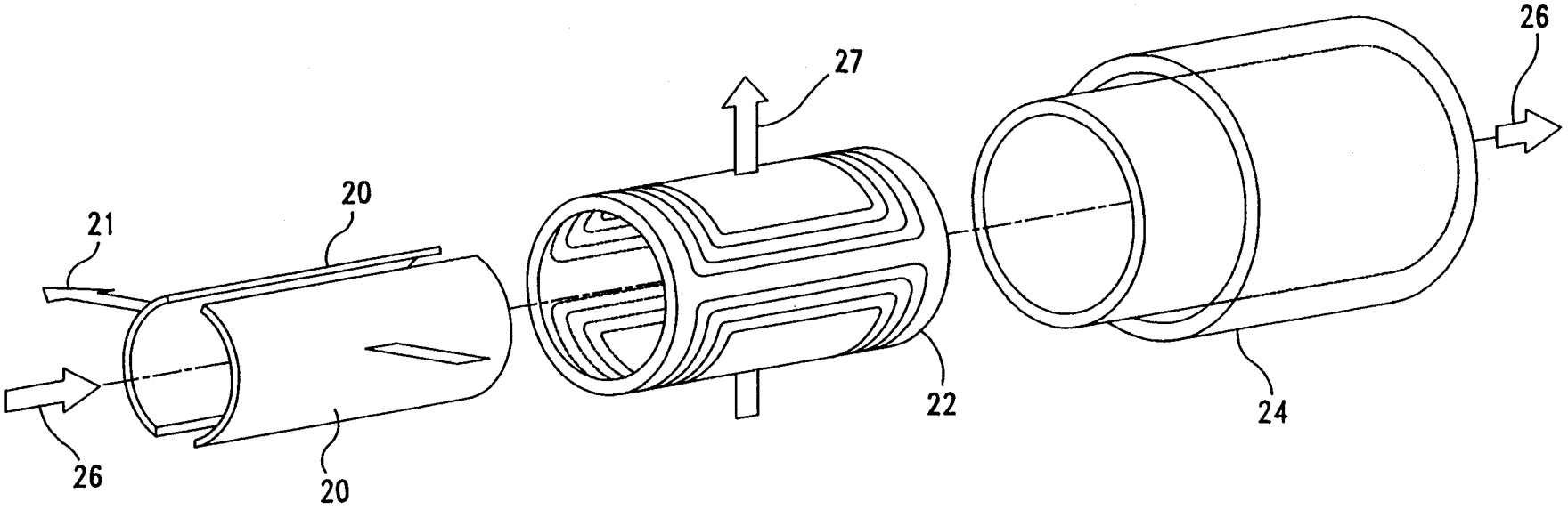
FIG. 3 is an exploded view of the electromagnetic drive unit.

FIG. 3 shows a specific configuration of the electrode, electromagnet and dewar in an exploded view. Arrows 26 depict the flow of water into and out of the thruster. Electrodes 20 produce electric field 21 oriented, in this illustration, in a horizontal plane. Superconducting electromagnets 22 produce magnetic field 27 oriented in a vertical plane. A Lorentz force is developed perpendicular to both field forces which drives the working fluid through the thruster. The resultant reactive force propels the vehicle forward. Cryogenic dewar 24 uses liquid helium for cooling and encloses the superconducting electromagnets 22.

Figure 4B:
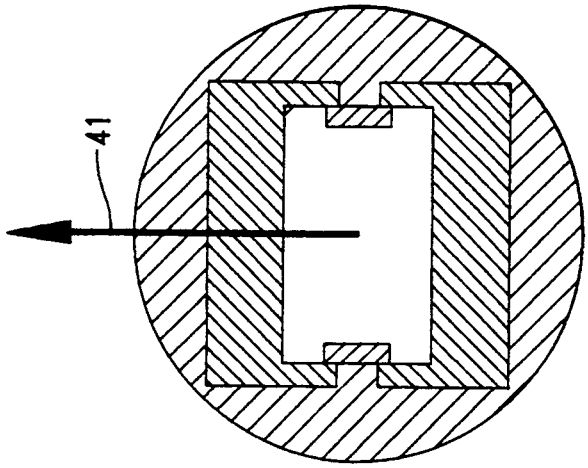
FIG. 4*b* is an end view showing the magnetic field and electric field vectors for the six-thruster configuration.
Figure 4A:
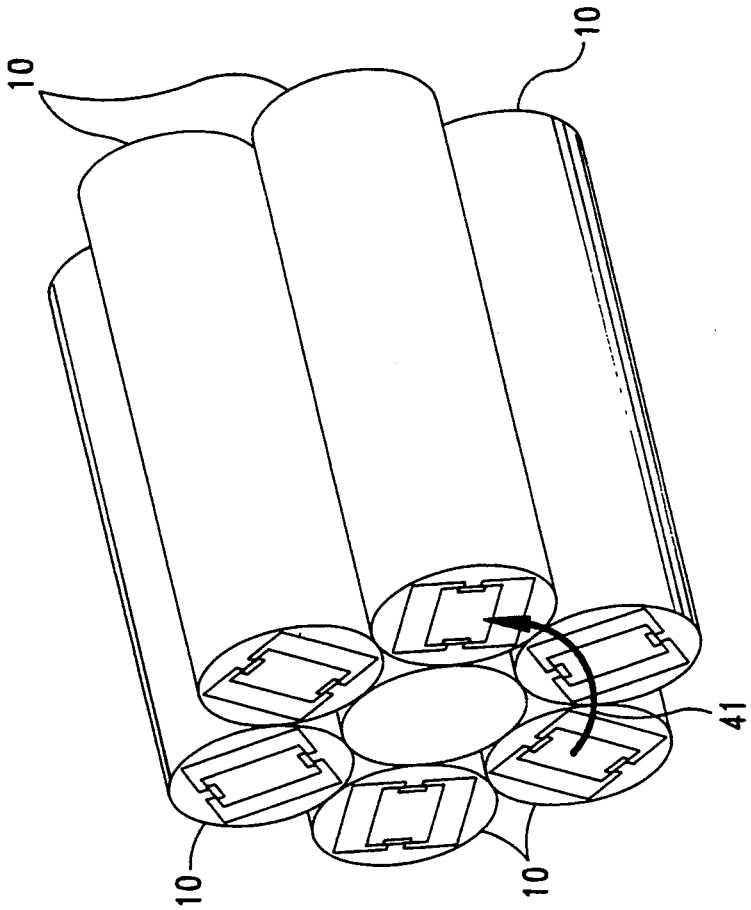
FIG. 4*a* is a perspective view showing a cluster configuration of six thrusters.

FIG. 4*a* depicts a multiple thruster configuration having six dipole type thrusters 10. This configuration allows the magnetic field of each adjacent thruster 10 to reinforce the magnetic field of the next thruster creating reinforced magnetic field and canceling the external magnetic fringe field.

FIG. 4*b*, an end view of the six-thruster configuration, shows the reinforcing effect. The magnetic field 41, a part of which is shown, is contained in a circumferential pattern, thereby confining most of the field within the thruster structure itself. By containing the magnetic field in this way, the probability of detection of the submarine or other marine vehicle is greatly reduced.

Figure 5:
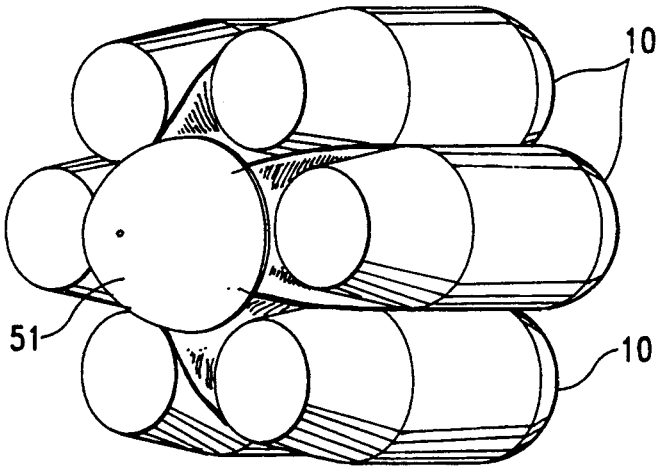
FIG. 5 is a rear perspective of the six-thruster configuration installed on a marine vehicle.
Figure 6:
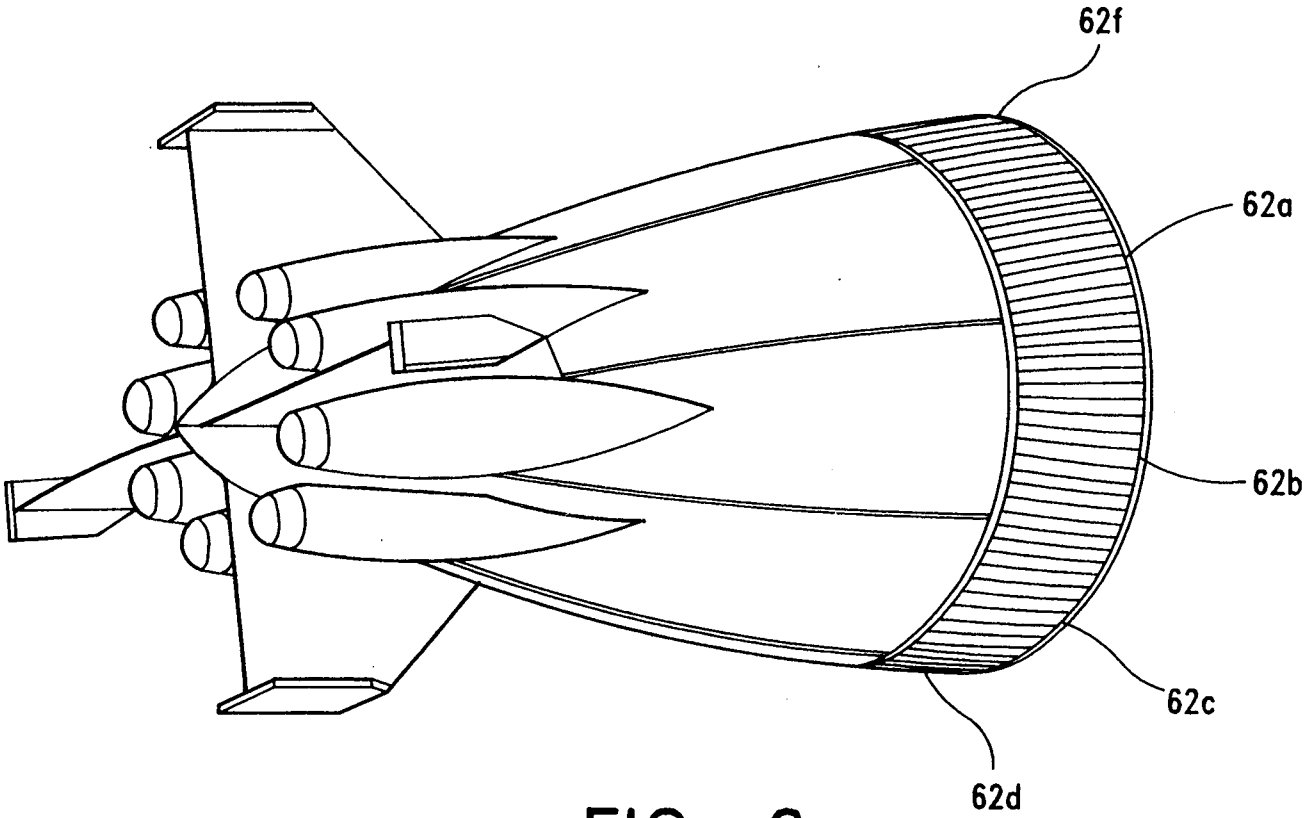
FIG. 6 shows a perspective view of a cluster configuration of thrusters using boundary layer control intakes as installed in a submarine.

FIG. 5 shows the multiple dipole thruster configuration as installed on a marine vehicle. Thruster 10 may be mounted on pylons or fairings located around the hull 51 of the vehicle. In this configuration, seawater is drawn in through conventional intakes at the forward ends of the thruster. Alternately, intake water may be drawn in through boundary suction ports. FIG. 6 shows the multiple-thruster configuration using a circumferential flush-mounted intake made up of six intake sectors, 62*a* through *f*, (62*e* not shown) providing a separate intake sector for each thruster. Part of the pressure head created in the thruster is needed to provide the suction pressure for drawing water into suction sectors 62(*a–f*). This pressure gradient may be expressed mathematically as a cross-product:

$$\vec{\nabla P}=\vec{J}\times\vec{B} \tag{1}$$

$$\vec{J}=\sigma\,(\vec{E}+\vec{U}\times\vec{B}) \tag{2}$$

$$\vec{\nabla P}=\sigma\,(\vec{E}\times\vec{B}+(\vec{U}\times\vec{B})\times\vec{B})=\sigma\,(\vec{E}\times\vec{B}-\vec{U}\vec{B}) \tag{3}$$

where, $\vec{J}$=Current density vector $\vec{B}$=Magnetic flux density vector $\vec{E}$=Electric field density vector $\vec{U}$=Velocity vector of seawater into the thruster $\sigma$=Seawater electrical conductivity The effect of the boundary layer intake on the thruster performance is a partial restriction of flow into the thruster. As can be seen by the preceding equations, velocity of seawater in the thruster reduces the pressure gradient. Use of the boundary intake produces the requirement to accelerate the flow radially inward in order to bring the seawater on board and also to accelerate the flow axially because the flow in the boundary layer is slowed by viscous effects over the hull of the vehicle.

Figure 7:
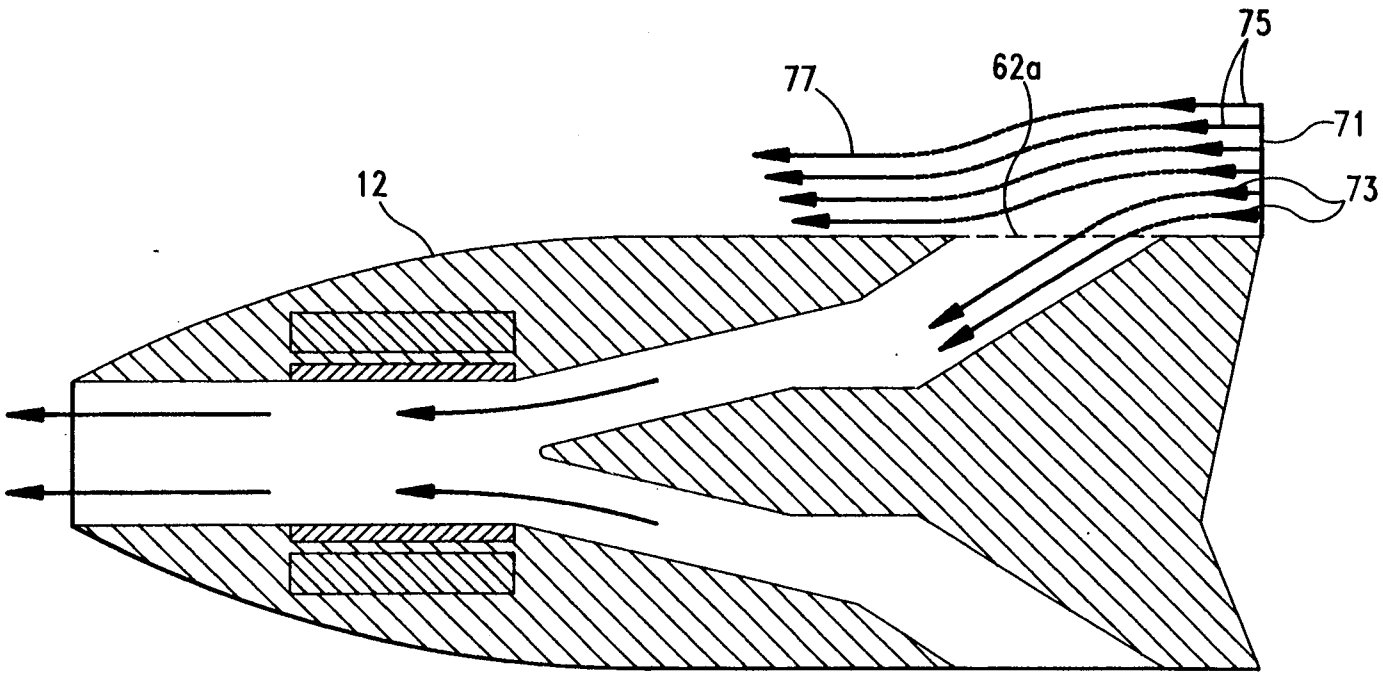
FIG. 7 is a longitudinal cross-section of the thruster showing the flow field using boundary layer control.

Referring now to FIG. 7, a representative boundary layer velocity profile is shown. Profile 71 upstream of the boundary layer intake 62*a*, shows a significant slowing of the near-hull flow streamlines 73 caused by viscous effects. The far streamlines 75, away from the hull, maintain a higher velocity and a less turbulent pattern. As the flow moves to intake 62*a*, flow streamlines 73 are drawn into the thruster and the faster moving flow streamlines 75 move closer to the vehicle hull 12.

The downstream velocity profile 77 shows increased energy with higher velocity near the hull. The overall effect is that the turbulence of the flow is reduced and thereby the radiated noise of the vehicle is also correspondingly reduced. The turbulence reduction continues along hull 12 for approximately ten times the longitudinal length of intake 62*a*. The thruster may be configured in other forms including a racetrack toroid annulus or a solenoid.

Figure 8A:
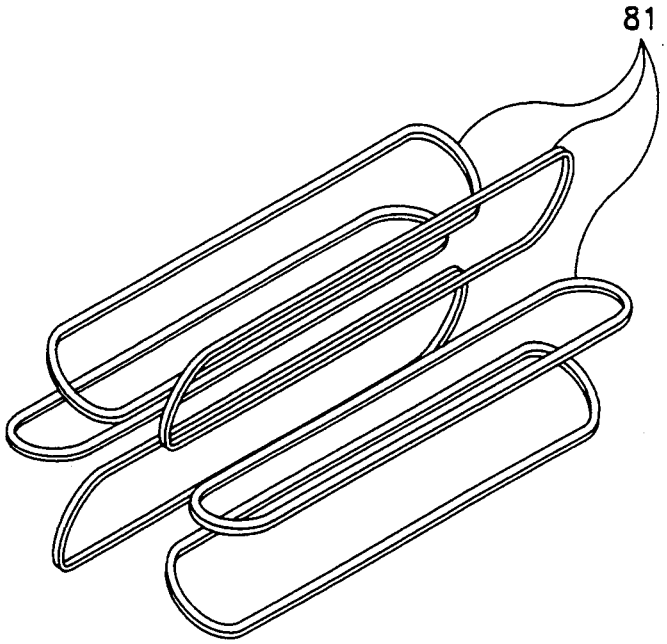
FIG. 8*a* is a perspective view of toroid configuration.

FIG. 8*a* shows a thruster with a toroid annulus magnet configuration. The toroid annulus thruster may be made up of 4, 6 or 8 sections but for purpose of illustration, only 6 sections are shown in FIG. 8*a*. The sections comprise the same components as those used in the saddle dipole arrangement. However, the electro-magnetic windings in the toroid annulus are spread out in such a manner that the magnetic flux density in the area of the thruster may be tailored to vary with the radial distance from the center of the annulus. This magnetic confinement is accomplished by geometrically shaping the magnetic coils 81 as shown in FIG. 8*a* so that the magnitude of the magnetic flux density varies with the radius of the annulus.

Figure 8B:
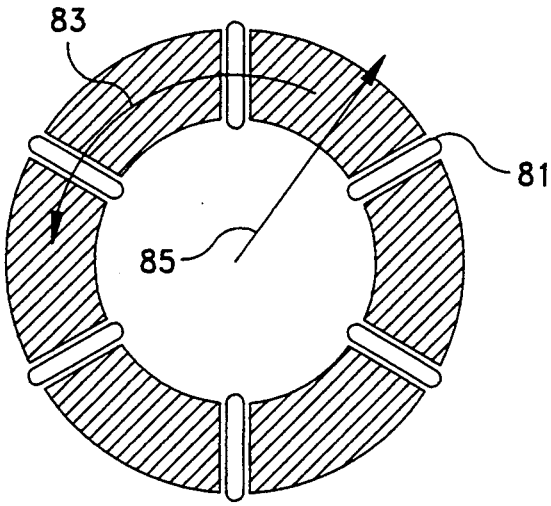
FIG. 8*b* is an end view of the toroid configuration showing the magnetic field and electric field vectors.
Figure 9:
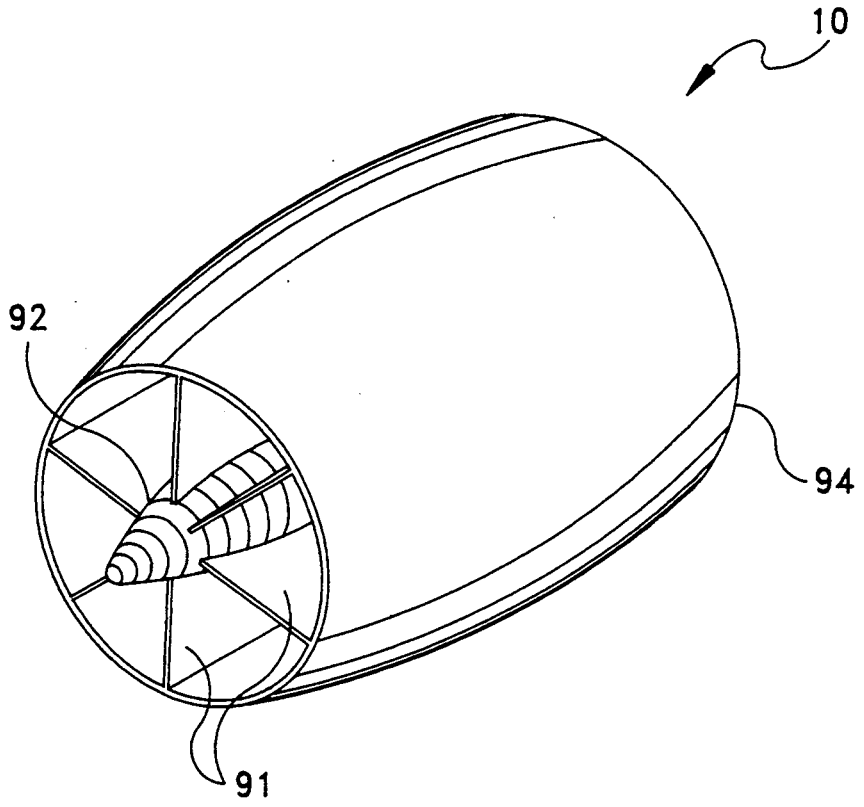
FIG. 9 is a perspective view of a thruster with a toroid magnet configuration.

FIG. 8*b* shows an end view of the toroid configuration with windings 81 producing a circumferential magnetic field vector 83, perpendicular to electric field vector 85. This interaction of electric and magnetic fields produces the identical result achieved with the multiple-dipole thruster configuration, that is, a Lorentz force driving the working fluid axially through the thruster. An exterior view of this configuration 10, shown in FIG. 9, has stator-like partitions 91 between the inner body 92 and the outer shell 94. These stator-like partitions enclose toroid winding not shown.

A further alternate embodiment is possible using a shielded solenoid configuration.

Figure 10A:
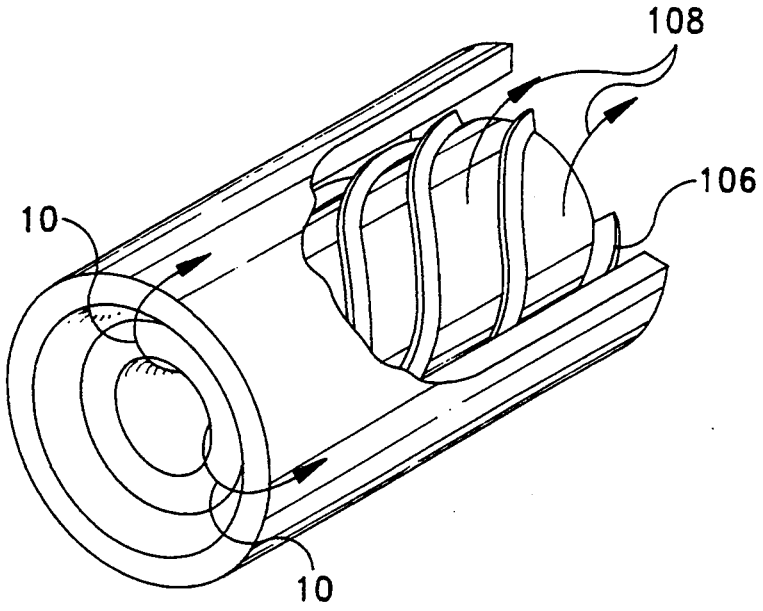
FIG. 10*a* is a cutaway of a solenoid configuration.

FIG. 10*a* shows the solenoid configuration in cutaway. The value of this configuration lies in the fact the many large magnets are commercially manufactured in this configuration and that the configuration provides better structural integrity than other configurations. The difficulty is, however, that the magnetic field vector is oriented axially along the thruster. In FIG. 10*a* the magnetic vector 101 is shown reversing from the inner annulus to the outer annulus.

Figure 10B:
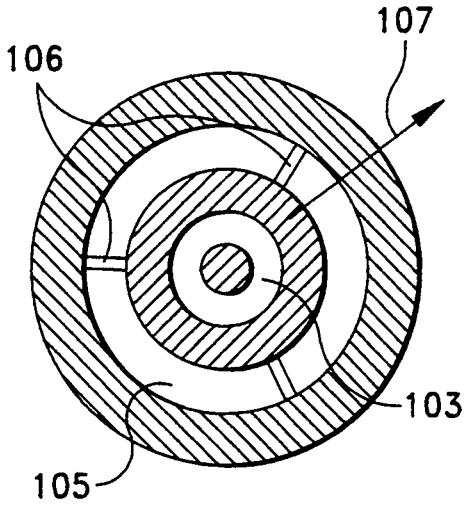
FIG. 10*b* is an end view of the solenoid configuration.

FIG. 10*b* shows the electric field vector 107 extending radially outward across annular duct 105 in the same orientation as the previous configurations. An inner annular duct 103 is also shown. The magnetic vector, however, extends axially into or out of the thruster. As a result the generated Lorentz force produces a push circumferentially around the annular ducts. In order to make this circumferential force useful for driving the seawater out the exit of the thruster, it is necessary to provide a segmented spiral 106 in annular duct 105. In effect, the water, shown by flow arrows 108 in FIG. 10*a*, moves circumferentially and spirals down through the thruster in a manner similar to that produced by a propeller or screw. However, in contrast to a conventional propeller, the screw is stationary and the water is rotating.

Figure 12:
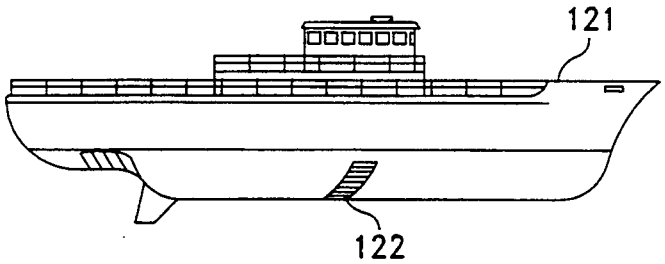
FIG. 12 shows a side view of an application of the thruster with boundary layer control to a conventional boat hull.
Figure 11:
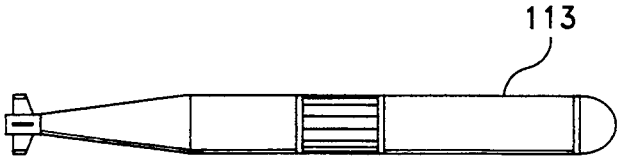
FIG. 11 shows a side view of the thruster installed on a torpedo with boundary layer control.
Figure 10:
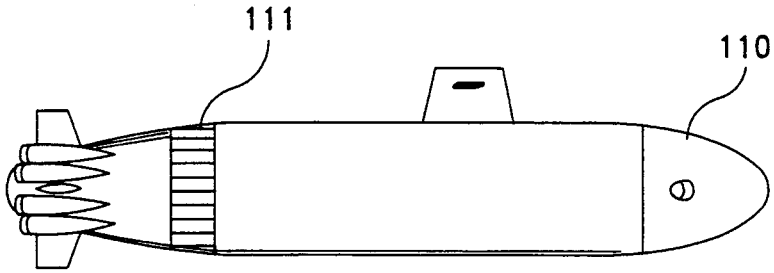
FIG. 10 is a side view of a submarine having boundary layer control with the thruster installed.

Referring now to FIGS. 10, 11 and 12, specific applications of the thruster are shown using boundary layer intakes. Submarine 110 has improved stealth characteristics through the elimination of moving parts and the reduction of turbulence resulting from boundary layer intakes 111, and likewise for torpedo 113. Surface boat 121 uses the boundary layer intake 122 to control the hull turbulence for the purpose of reducing hull drag. A slotted exit nozzle can further reduce boat tail drag.

Figure 13:
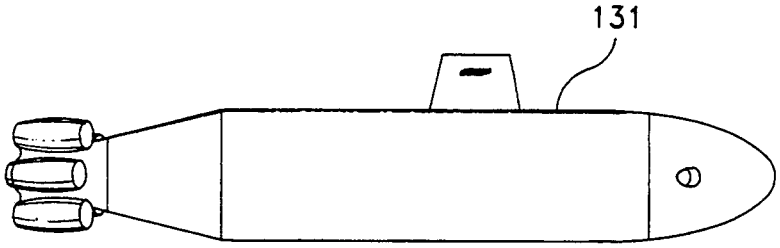
FIG. 13 shows a side view of the thruster installed in a submarine with conventional intakes.
Figure 14:
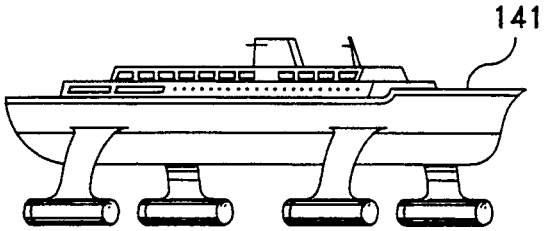
FIG. 14 shows a perspective view of the thruster installation on a hydrofoil vehicle.

Referring to FIGS. 13 and 14, conventional intakes are shown in an underwater application 131 and a surface application 141. Advantages of this propulsion system over conventional screws include the ability to apply greatly increased force to the seawater without causing cavitation. Conventional propellers and screws cavitate at high loads. The electromagnetic thruster does not cavitate and therefore can provide greater speeds than are currently possible. A doubling of the present maximum underwater speeds appears feasible.

Thus, it will be understood that many additional changes in the design details, materials, steps and engineering arrangement of parts, which have been herein described and illustrated in order to explain the nature of the invention that may be made by those skilled in the art within the principle and scope of the invention as expressed in the appended claims.

What is claimed is:

1. A thruster for marine vehicles comprising:

ducting for intake and expulsion of water comprising a tube with a section having a porous surface extending laterally around the hull of the marine vehicle and positioned so as to draw in boundary layer flow from around the vehicle;

means for producing a high current density electric field acting across said ducting;

means for producing an enhanced magnetic field collocated with and oriented so as to provide a magnetic field vector perpendicular to said electric field;

means for supercooling said means for producing a magnetic field thereby allowing superconductivity and the generation of a strong magnetic field tailored to generate a uniform Lorentz force field; and means for mounting said thruster on a marine vehicle.

2. A thruster for marine vehicles comprising:

ducting for intake and expulsion of water comprising a plurality of rectangular ducts arranged in a cylindrical configuration, each duct having a magnetic dipole oriented so that the field vector of the dipole extends circumferentially toward the next adjacent duct thereby creating a circular magnetic field vector through the entire plurality of ducts;

means for producing a high current density electric field acting across said ducting;

means for producing an enhanced magnetic field collocated with and oriented so as to provide a magnetic field vector perpendicular to said electric field;

means for supercooling said means for producing a magnetic field thereby allowing superconductivity and the generation of a strong magnetic field tailored to generate a uniform Lorentz force field; and means for mounting said thruster on a marine vehicle.

3. A thruster for marine vehicles as in claim 2 wherein each of said plurality of rectangular ducts has electrodes located along a radial line of the cylindrical configuration so that the electric field vector extends outward along radial lines.

* * * * *